United States Patent [19]

Wicklund

[11] 3,994,487

[45] Nov. 30, 1976

[54] SHEET HANDLING APPARATUS

[75] Inventor: Harold Pershing Wicklund, San Jose, Calif.

[73] Assignee: International Business Machines Corporation, Armonk, N.Y.

[22] Filed: Oct. 31, 1975

[21] Appl. No.: 627,740

[52] U.S. Cl. ..... 271/80; 271/184; 271/213; 271/223; 271/274

[51] Int. Cl.² ..... B65H 29/22; B65H 29/58; B65H 33/08

[58] Field of Search ..... 271/80, 184, 213, 214, 271/223, 224, 273, 274

[56] References Cited

UNITED STATES PATENTS

| | | | |
|---|---|---|---|
| 3,135,446 | 6/1964 | Sargent | 225/100 |
| 3,304,084 | 2/1967 | Ashton | 271/80 |
| 3,735,978 | 5/1973 | Turner et al. | 271/80 |

FOREIGN PATENTS OR APPLICATIONS

| | | | |
|---|---|---|---|
| 1,256,289 | 12/1971 | United Kingdom | 271/213 |

OTHER PUBLICATIONS

Manning et al; "Sheet Stacking Technique"; IBM Technical Disclosure Bulletin; vol. 17, No. 8; Jan. 1975; p. 2255.

*Primary Examiner*—Robert W. Saifer
*Attorney, Agent, or Firm*—Otto Schmid, Jr.

[57] ABSTRACT

Sheet handling apparatus for feeding just-burst sheets along a sheet path to a stacker mechanism where the sheets are stacked on end in the same order they entered. The stacker bed is adjustable to receive any of a predetermined sizes of sheets. A plurality of feeding means is spaced along the sheet path and these feeding means are actuated to feed the predetermined size sheet by setting the stacker bed in position. As the sheets are fed along the sheet path, each sheet can be selectively laterally offset to facilitate the separation of the sheets into sets of copies, data sets or jobs.

14 Claims, 7 Drawing Figures

SHEET HANDLING APPARATUS

BACKGROUND OF THE INVENTION

This invention relates to apparatus for sheet handling apparatus and more particularly to sheet handling apparatus which is automatically adjustable to feed a predetermined one of a number of sheet sizes.

A typical computer output printer operation sometimes has the requirement that the continuous forms (fan-fold) output be trimmed and separated into sheets and then further separated into sets of copies, data sets, or jobs for distribution to customers and/or operating segments of the organization. This work has traditionally been done off-line using a manually set up burster and trimmer and by manual separation of copies, data sets and jobs. As computer printers have been developed which operate at higher and higher printing speeds, the postprinting processing of the printed output has become more of a problem in achieving the throughput the printer is capable of producing. For this reason, it would be desirable to perform these operations on-line in the printer. It is the purpose of this invention to provide apparatus for on-line separation and distribution of continuous forms output from a high speed computer printer without interruption of the continuous running of the printer.

SUMMARY OF THE INVENTION

Briefly, according to the invention, there is provided sheet handling apparatus comprising a plurality of selectively actuable sheet feeding means spaced along a predetermined path, including offset feeding means for selectively moving a predetermined sheet to a laterally offset position in response to an electrical control signal as the predetermined sheet is moved along the sheet path. A sheet receiving means is positioned to receive sheets from the sheet path and the sheet receiving means includes means for setting the sheet receiving means to receive a predetermined size sheet and means actuated by the setting is provided to also selectively actuate the feeding means for feeding the predetermined size sheets to the sheet receiving means.

DETAILED DESCRIPTION OF THE PREFERRED EMBODIMENT

Figure 1:
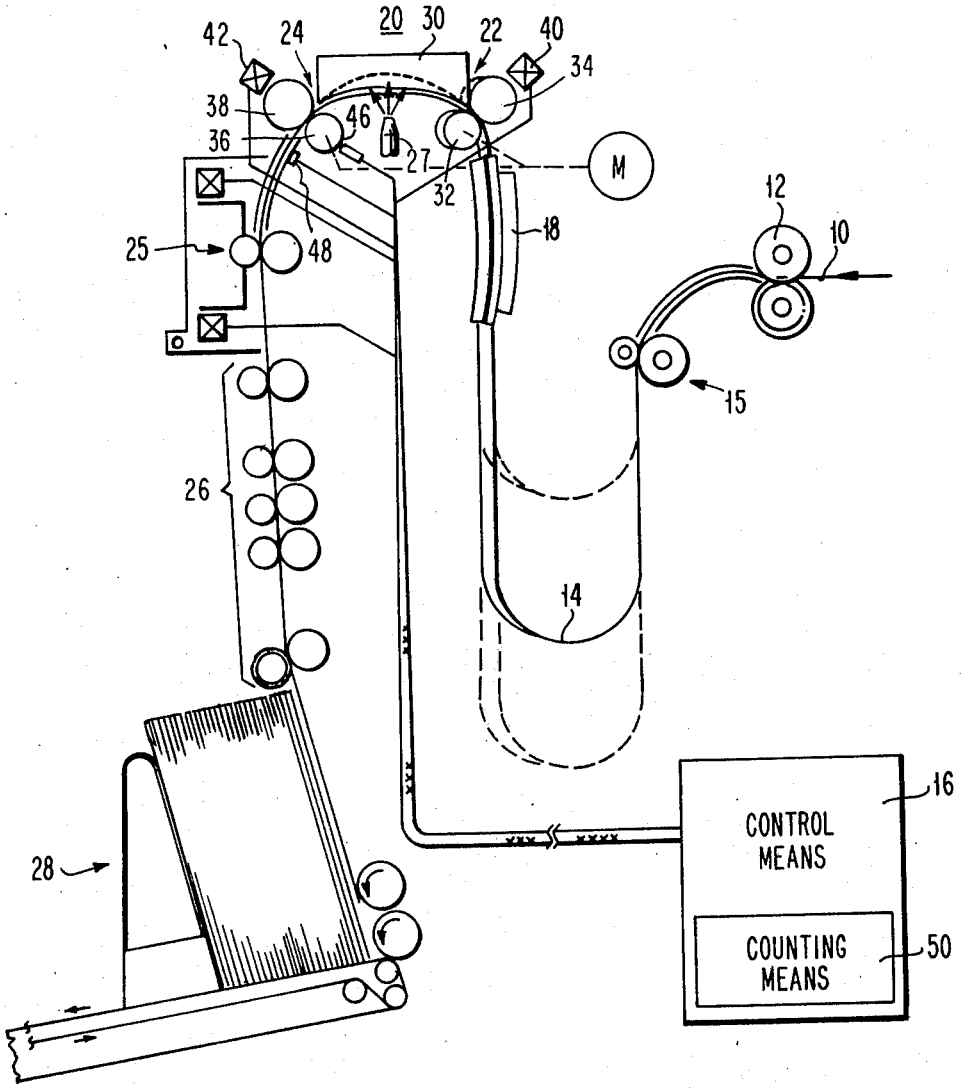
FIG. 1 is a schematic front view of a web processing system embodying the present invention.
Figure 2:
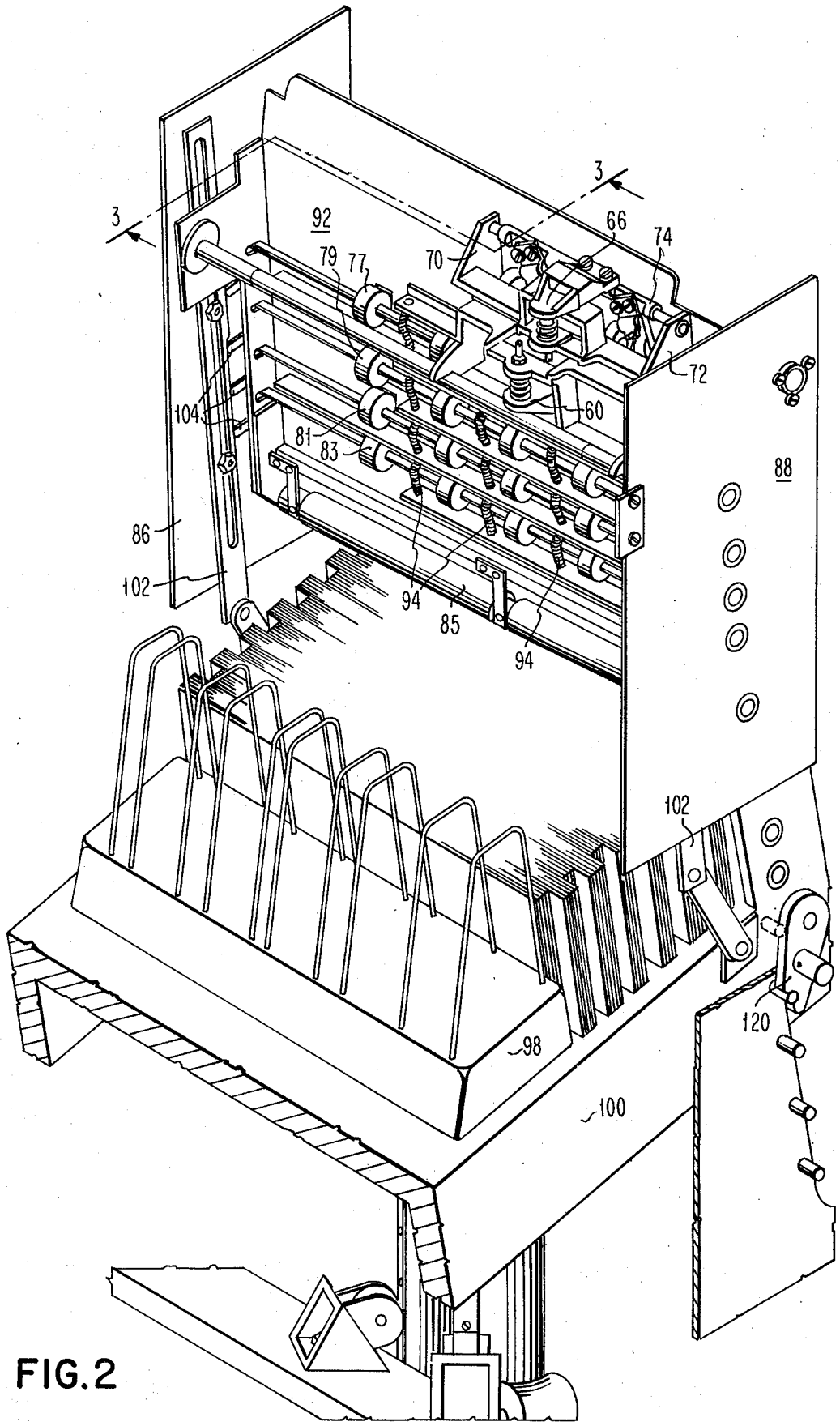
FIG. 2 is an isometric view of the sheet handling apparatus.
Figure 3:
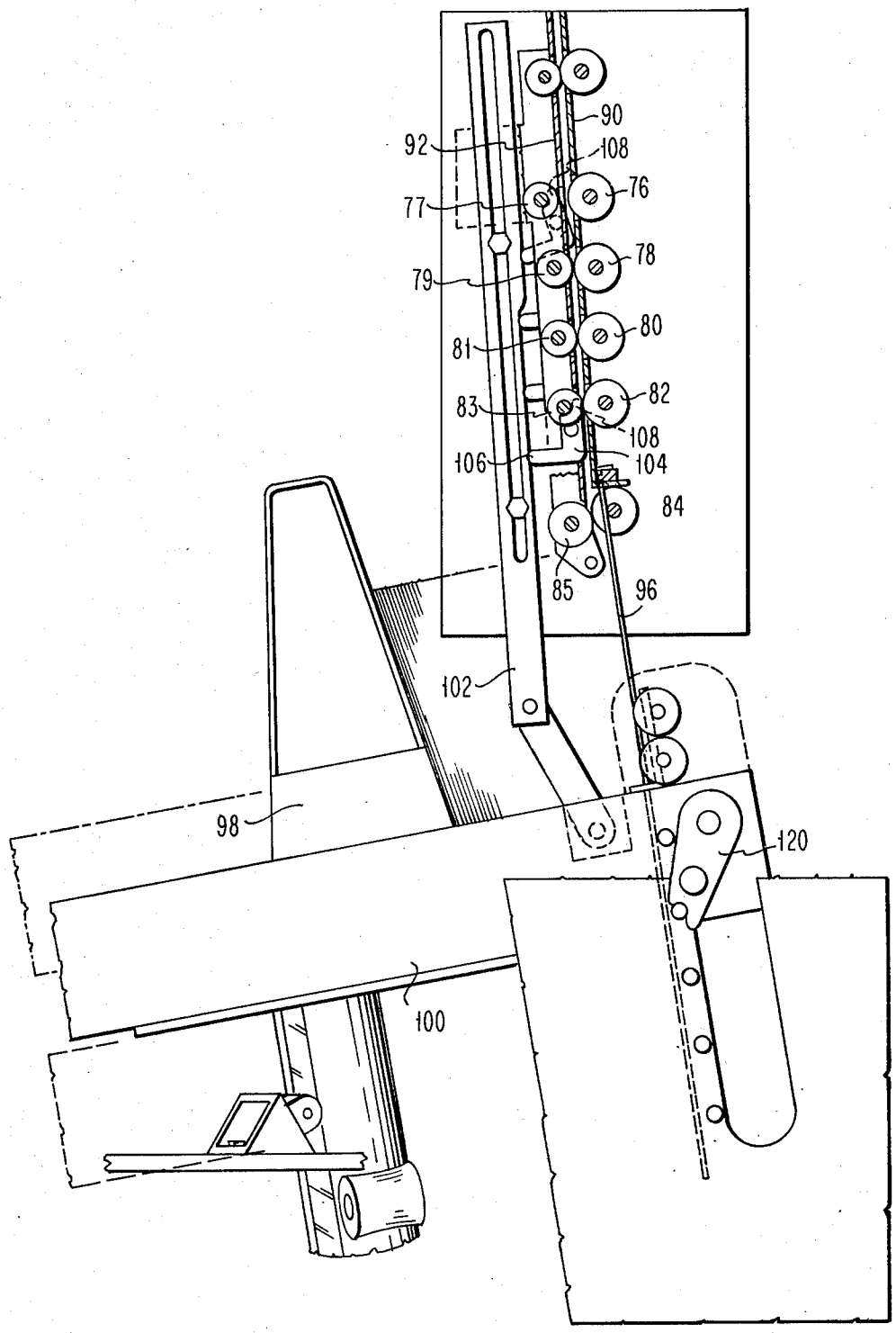
FIG. 3 is a partial section view along lines 3—3 of FIG. 2.
Figure 4:
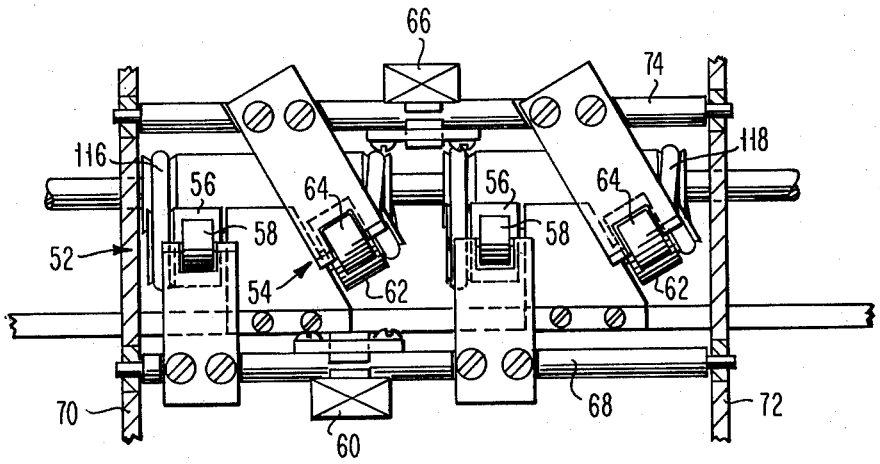
FIG. 4 is a view showing the offset station.
Figure 5:
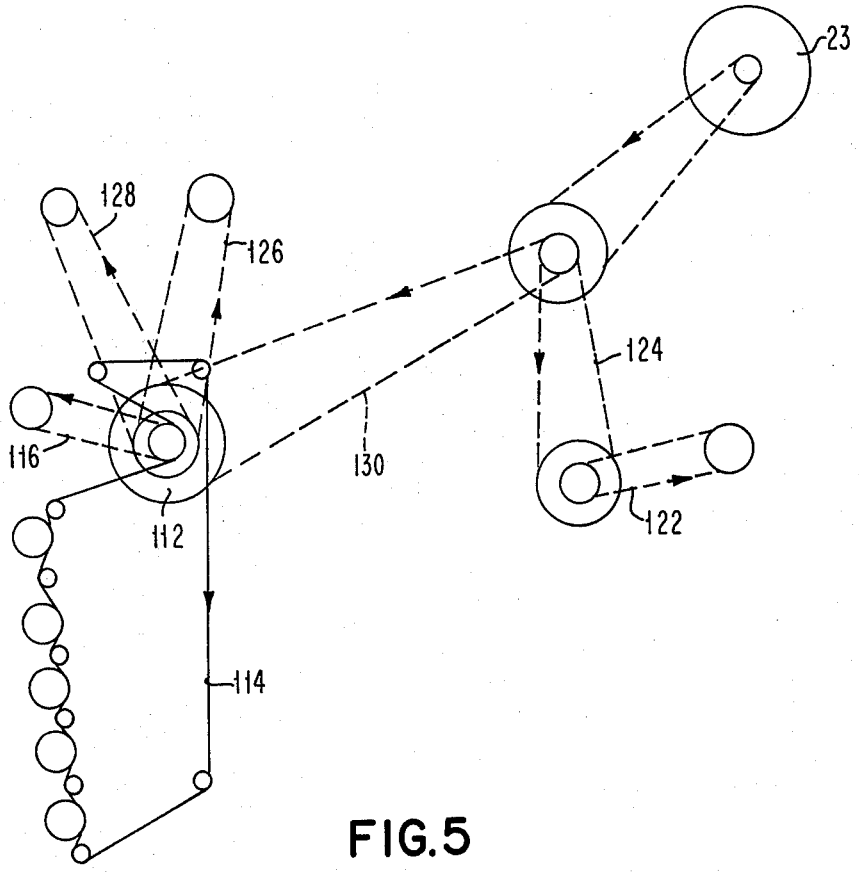
FIG. 5 is a diagrammatic view showing the drive belt arrangement for the sheet handling apparatus.

The invention will be described as a part of a post-processing system for operation on-line with a computer output printer. However, it will be obvious to those skilled in the art that this sheet handling apparatus has characteristics which will render it usable in a wide variety of applications.

The continuous form web 10 from the printer is fed through suitable guides to trimmer apparatus 12. The trimmer apparatus functions to trim, by means of two co-acting rotary knives, the trim strip on each side of the web which carries the tractor holes which may have been used to feed the web up to this point. The trimmed web is then guided into a buffer loop 14. The function of the buffer loop is to de-couple the post-processing apparatus from the printer since the post-processing apparatus runs at a faster rate. Scuff rolls 15 are driven at a faster speed than web 10 and these rolls slip on web 10, thereby establishing the buffer loop as fast as the web 10 comes from the associated printer. When a maximum loop has been established, the post-processing apparatus is run until some minimum loop results, at which time the process stops. The process is repeated when the maximum loop is again reached. The loop is adjusted for a given length during thread-up so that control means 16 can use this information along with the known length of forms being printed to keep track of individual printed sheets in the web throughout the post-processing operation.

From the buffer loop the web proceeds through steering guides 18 to burster apparatus 20 by means of first feeding means 22 which is driven at a speed slightly in excess of the nominal printer speed. Bursting is accomplished by second feeding means 24 which is selectively actuated for feeding the web at a speed substantially faster than the input speed so that the sheet is separated along the transverse pre-weakened line. The burst sheets are fed along a sheet path by sheet handling apparatus 26 to a suitable sheet receiving means 28. An offset station 25 is provided along the sheet path between burster apparatus 20 and sheet handling apparatus 26 to selectively give a sheet a lateral component of motion while maintaining the same forward component of velocity along the sheet path. A curved guide member 30 is positioned between input feeding means 22 and burster feeding means 24 to define the outer boundary of the curved web path. Feeding means 22, 24 are selectively actuated by an electrical control signal from control means 16 to the respective operating magnets 40, 42. Magnet 40 is actuated on a PROCESS signal from control means 16 to activate first feeding means 22 and feed the web squarely into this feeding means. A bend or "buckle" is formed as the web is forced to follow the curvature of guide member 30 and the curvature of guide member 30 is designed so that the web is also fed squarely into second feeding means 24. A BURST signal is produced by control means 16 at the appropriate time for bursting the sheet size being processed. The sheet size being processed is indicated by the operator at the start of a printing job by a push button on the control panel, for example, and the control unit utilizes this information to generate the BURST signal at the appropriate time.

The distance along the curved web path between feeding means 22 and feeding means 24 is chosen to be approximately the length of the shortest sheet to be processed, for example, 3.6 inches for 3½ inch sheet. Thus, when processing 3½ inch paper, the burster feeding means 24 remains engaged and separation of the web into 3½ inch sheets is accomplished in a continuous operation.

However, for sheets longer than the minimum length, a control signal is provided to control bursting at the appropriate time for the sheet length being processed. The control signal is provided by control means 16. Control means 16 may comprise hard-wired control circuits designed to produce the desired control functions. Alternatively, control means 16 may comprise signals generated from programmed instructions from the data processing system of which the printer is a part. The means for generating the burster control signal comprises sheet position sensor means 48 and pulse producing means 46 which functions to produce a series of electrical control pulses, the frequency of which is proportional to the speed of the web through feeding means 24. In the embodiment shown, pulse producing means 46 comprises an emitter which is coupled to the same shaft as the burster feed roll. The emitter comprises a circular member having a plurality of spaced teeth members on its peripheral surface. When one of the teeth members is aligned with a magnetic pickup member, a low reluctance path is established and an electrical pulse is produced in the pickup circuit. In the embodiment shown, sheet position sensor means 48 comprises a photodetector mounted adjacent the web path near feeding means 24 and a light source mounted adjacent the detector. When the leading edge of the web comes to the light source and detector, a signal is generated which signifies to the control means that the web has arrived at a known position. The light and photocell could also be mounted so that the web comes between them to generate the signal. The edge detector signal is utilized to start a count of the pulses from emitter 46. When the count reaches the number corresponding to only the minimum length of sheet remaining between feeding means 22, 24, a signal is generated to energize magnet 42 to engage second feeding means 24, thereby initiating bursting.

The apparatus for separating the sheet from the web is described in greater detail and claimed in copending application Ser. No. 627,713 filed Oct. 31, 1975 entitled "Burster Apparatus" by John S. Moffitt.

The offset station 25 is positioned in the sheet path between burster apparatus 20 and sheet handling apparatus 26. The offset station comprises selectively actuable feeding means that are actuated at the appropriate time to transport the sheets from the burster to the sheet handling apparatus in two different modes. One mode is in response to a STRAIGHT AHEAD signal from control means 16 which provides positive control over the sheet motion to keep it moving along the sheet path at the selected post-burst velocity. The second mode is in response to a OFFSET signal from control means 16 which provides positive control at the same velocity in a forward direction as the straight through operation but also adds a lateral component of motion so that the sheet is laterally displaced as it is fed through the offset station. This is important to the operation since any lessening of the forward velocity would permit a later sheet to "catch up" with a sheet being offset and lead to sheet jams or other problems along the sheet path.

The offset station comprises one selectively actuable feeding means 52 for feeding sheets straight through and another selectively actuable feeding means 54 for selectively giving the sheets a lateral displacement as the sheets are fed along the sheet path. The feeding means 52 comprises a set of two continuously running rolls 56 and co-operating with these rolls are two pressure rolls 58 selectively actuable by a STRAIGHT AHEAD signal to control magnet 60. Offset feeding means 54 comprises a set of two continuously running feed rolls 62 set at an angle to the sheet path and the velocity along the sheet path is related to the offset roll velocity by the tangent of the angle. When the cooperating pressure rolls 64 are actuated by OFFSET signal to control magnet 66, a lateral component of motion is provided while maintaining the same forward component of velocity as the other two straight ahead rolls 56. In the embodiment shown, straight ahead pressure rolls 58 are mounted on pivot shaft 68 which is journaled between side plates 70, 72. Offset pressure rolls 64 are mounted on pivot shaft 74 which is also journaled between side plates 70, 72.

In the embodiment shown, sheet handling apparatus 26 comprises a plurality of feeding means, each including a constantly running feed roll in nip forming relationship with a selectively actuable pressure roll. The feeding means are spaced along the sheet path in position to each feed one standard size sheet. In the embodiment shown, these rolls sets are spaced 3.5, 5.5, 7, 8.5 and 11 inches from the offset station. Sheet receiving means 28 is at the end of the sheet path formed by the feeding means and it is adapted to receive the sheet serially in the same order that they are printed.

The sheet handling apparatus 26 comprises in the embodiment shown in the drawings a number of constantly running feed rolls 76, 78, 80, 82, 84 suitably mounted between end members 86, 88. A guide member 90 is fixedly mounted between end members 86, 88 adjacent feed rolls 76, 78, 80, 82, 84 with openings for feeding engagement with sheets moving along a path between guide members 90, 92. Guide member 92 comprises a similar guide means for mounting corresponding pressure rolls 77, 79, 81, 83, 85 so that they are biased by means of spring means 94 toward engagement with the feed rolls. Guide member 92 is pivotally mounted at the bottom relative to guide member 90 so that these guide members can be separated for easy access to the sheet path.

In the embodiment shown, sheet receiving means 28 comprises a fixed guide member 96 at one end substantially in line with the sheet path. The sheets are driven into the sheet stacker 28 on end alongside backstop member 98 down to stacker bed member 100. Backstop member 98 is fixed at a small angle to the vertical so that a component of gravity tends to make the top of the sheet lean away from the entry point. In addition, the stacker bed 100 is positioned at a small angle to the horizontal. A convenient angle for the stacker bed to facilitate unloading of the stacker while printing is about 12°. The sheets abut backstop member 98, and backstop 98 moves back as the stack accumulates against the pressure supplied by a constant force spring member. The force of this spring returns the backstop against the residual stack as quantities of sheets are removed from the stacker by hand. The backstop is tilted back about 8 degrees from the position of guide member 96 so that a relatively narrow throat for entry of the first sheet is provided.

The vertical position of the stacker bed 100 is set to receive the length of sheet being processed. This is accomplished by the operator by moving the stacker bed to detented positions by setting means 120 for each sheet length or by mechanism designed to produce this movement to a detented position in response to a signal from control means 16. An adjusting means is operable in response to setting the position of the stacker to also selectively actuate the sheet handling means 26 for feeding the selected size sheets along the sheet path. In the embodiment shown in the drawings, adjusting means comprise linear cam means 102 which is pivotally attached at one end to stacker bed 100 and is mounted for sliding motion on end members 86, 88 in accordance with the stacker bed position. Linear cam means 102 is mounted adjacent bell crank members 104 so that the high point of cam 102 engages the arm 106 of bell crank means 66 and pivots the member so that the arm 108 of the member 104 engages the shaft on which the pressure rolls are mounted and moves them against the bias of spring 94 72 out of engagement with the respective drive roll. For example, when the stacker bed 100 is in the up position to process 3.5 inch long sheets, then all the feed rolls 76, 78, 80, 82, 84 are engaged with their pressure rolls 77, 79, 81, 83, 85. When bed 100 is lowered to the position to process 5.5 inch long sheets, cams 102 lift the 3.5 drive roll 76 out of engagement with its pressure roll 77 and so on until the stacker bed is at its lowermost position for 11 inch long sheets in which case only feeding means 84, 85 is engaged.

The components of the sheet handling apparatus are driven by suitable belts or gears from a suitable drive motor. In the embodiment shown motor 23 provides the motive force for the components of the system. Suitable timing belt drives are provided (shown dashed in the drawings) with pulley sized to provide the appropriate speed for the trimmer apparatus 12 by belt 122, the scuff rolls 15 by belt 124, first feeding means 22 by belt 126, second feeding means 24 by belt 128 and pulley means 112 by belt 130. A flat belt drive 114 is provided from pulley means 112 to drive sheet handling apparatus 26. An O ring drive 116 is provided to the straight ahead drive rolls 56. An O ring drive 118 is also provided to offset drive rolls 62. This drive is to a smaller pulley so that rolls 62 are driven at a higher velocity than rolls 56. This higher velocity permits rolls 62 to drive the sheets at the same forward velocity as rolls 56.

In accordance with a specific embodiment of the invention, a specific example for control of the sheet handling apparatus will be described for sheet lengths of 3.5, 5.5, 7, 8.5 and 11 inches. Control of the apparatus is different for the minimum length sheet (3.5 inches in the specific example) and other sheet lengths. Operation is basically continuous for the minimum length sheets and for other sheet lengths the bursting is timed for the sheet length being processed. Control of the timing for the burster operation is accomplished by counting means 50 which is a count-down counter in the specific example. A specific example of the overall operation will now be given for the 3.5 inch length and the 8.5 inch length which is illustrative of all the remaining lengths.

For the 3.5 inch length, the apparatus is designed for this minimum length so continuous operation of the burster is possible in this case. Bursting is accomplished by feeding means 24 running at a higher rate than feeding means 22. As the leading edge of the burst sheet emerges from the burster output feeding means 24, it is guided to the offset station, the pinch point of which is 3.5 inches from the pinch point of feeding means 24. Thus, as the trailing edge is leaving feeding means 24, the leading edge is entering offset station 25. The straight ahead rolls 58 are engaged so that the sheet is simply fed forward until the trailing edge of the sheet passes the detector means 48. At this point in time, the control unit decision to offset or not is executed. If there is no signal to offset, the straight ahead rolls remain engaged until they run off the end of the sheet. If an OFFSET signal is received from control means 16, then straight ahead rolls are disengaged by de-energizing magnet 60 simultaneous with the action of energizing magnet 66 which causes the offset rolls to be engaged to give the sheet a lateral component of velocity until the rolls run off the trailing edge of the sheet. The 3.5 inch drive roll 76 which is located 3.5 inches from the offset station so when the trailing edge leaves the offset station, the leading edge will be caught by driving means 76 so that the sheet will again be driven straight ahead through the other feeding means and into the sheet stack which is set with the stacker bed approximately 3.5 inches from feeding means 84.

Figure 6:
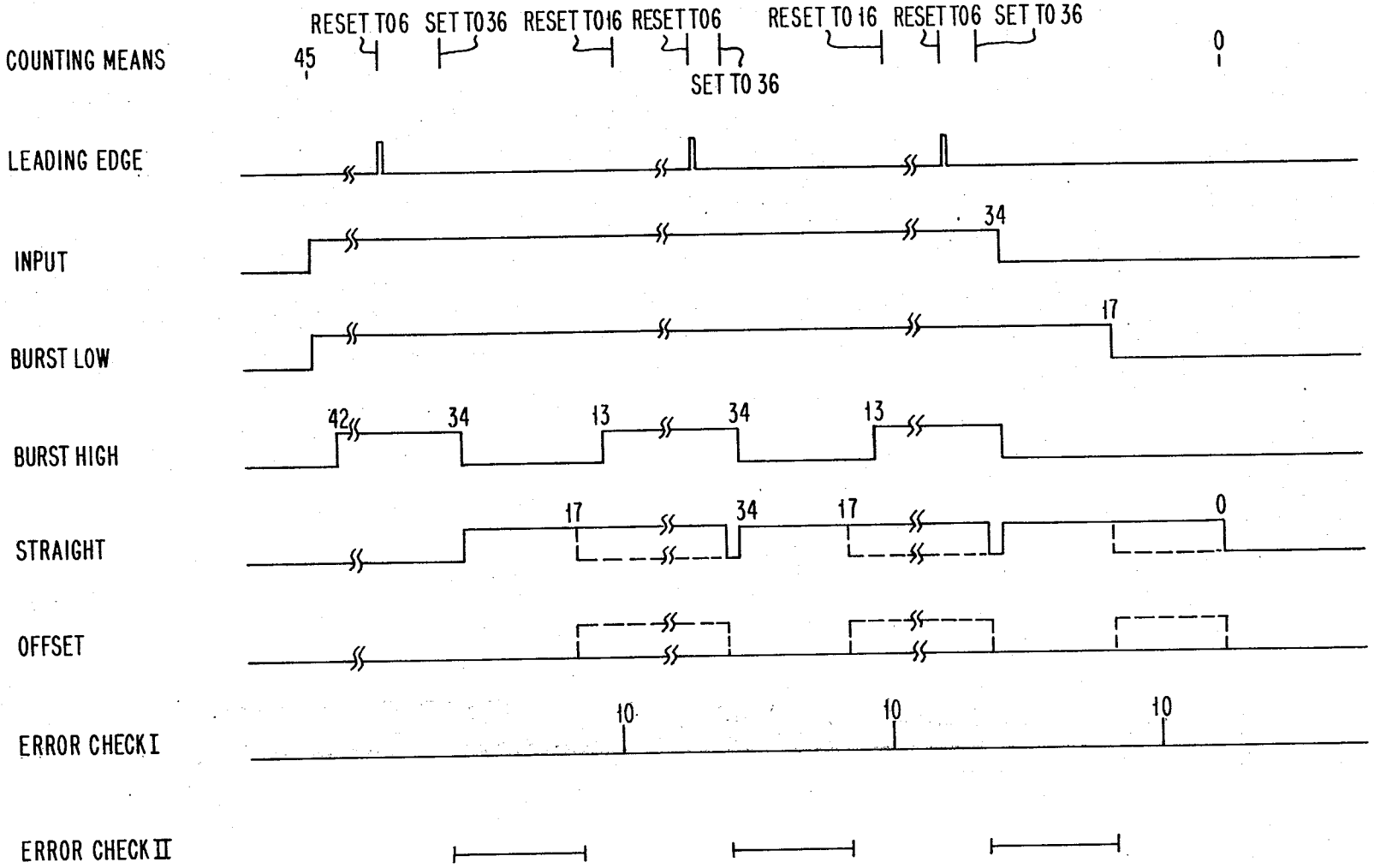
FIG. 6 is a timing diagram showing the relative times at which various components are actuated to control the sheet separation and distribution operation for minimum length sheets.

The timing for control of the various operations for processing 3.5 inch sheets is shown in FIG. 6. When processing 3.5 inch sheets, the operation is continuous and starts in response to a PROCESS signal from control means 16. A count of 45 is set into counting means 50 and magnet 40 is energized to close pressure roll 34. The web is present between rolls 32 and 34 from the intial thread-up operation or from a previous burst operation so closure of the rolls starts the feed of web 10 through the burster apparatus. A signal BURST LOW current is also generated at this time and sent to magnet 42 to close burster pressure roll 38. The full current is not applied at this time to reduce noise and vibration as the magnet is energized. At count 42 a signal BURST HIGH current is applied to magnet 42 to develop the full force between the burster rolls. Feeding continues until one of two events occurs.

The first possibility is that the counter which is decremented by pulses from emitter 46 reaches zero before the leading edge of the web reaches sensor means 48 and in this case an error is indicated and feeding is stopped. The count of 45 would normally provide sufficient time for the leading edge of the web to be fed to sensor 48, so the failure to arrive within that time indicates either a jam along the web path, that the control unit 16 has lost synchronism with the sheets forming web 10 or some other malfunction.

The second possibility is that the leading edge of the web reaches sensor 48 before the counter reaches zero. A LEADING EDGE signal is generated as a result and this signal is sent to the control means. Some flutter can occur as the leading edge of the web moves along the path so a count of six elapses after the leading edge is first detected before further control action is taken to remove the possibility of spurious results due to leading edge flutter. After six counts have elapsed, the offset station straight ahead rolls are reset open and a count of 36 is placed in counting means 50. The burster operates as previously described and at count 34 the BURST HIGH current signal goes down and the straight ahead rolls are energized. An offset decision is made at count 17 and this is shown dotted since this is a selective function. If detector 48 sensed a second leading edge during the bursting operation, this is an error indication since the sheet has been separated at the wrong place or the control unit has lost synchronism with the web movement. This check is shown as error check II in FIG. 8. An error check is made at count 10 to determine whether sensor 48 is uncovered since at this time the trailing edge of the just-burst sheet should have cleared the sensor. If not, this means that the sheet was not burst or that the control unit has lost synchronism with the web movement. Under normal operation the sensor is uncovered at the error check time and a count of 16 is set into counter 50. This count provides sufficient time for the leading edge of the next sheet to reach sensor 48 before the counter reaches zero under normal operating conditions. This sheet and all subsequent sheets are processed as shown in FIG. 6 in a continuous fashion until the control unit decision is made that the current sheet is the last sheet to be processed. As can be seen by reference to FIG. 6, for the last sheet the input rolls are opened at count 34 and the burster rolls 36, 38 are opened at count 17. This leaves the end of web 10 between input rolls 32, 34 in position for further operation.

Figure 7:
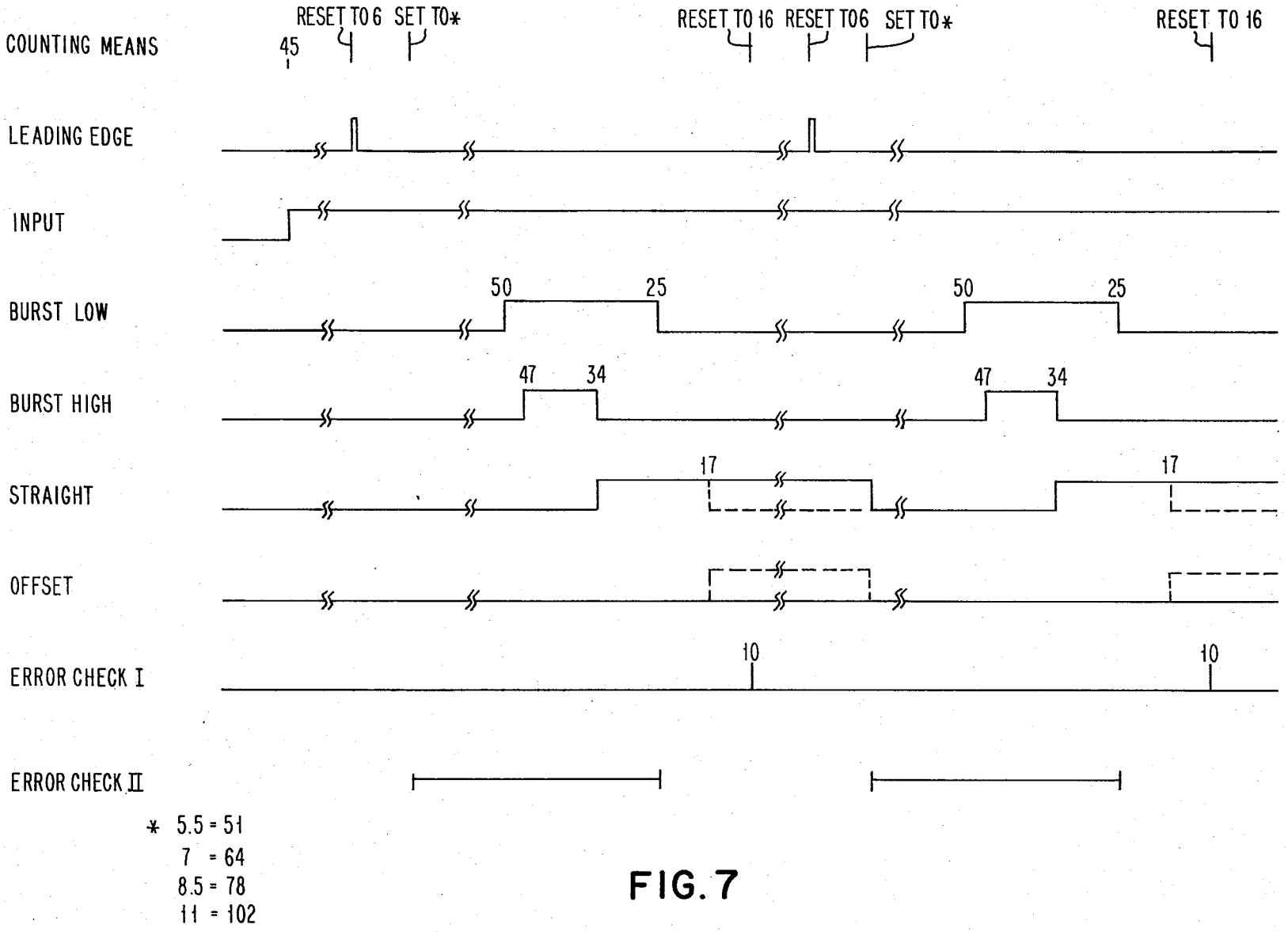
FIG. 7 is a timing diagram showing the relative times at which various components are actuated to control the sheet separation and distribution operation for other length sheets.

Now, considering the 8.5 inch length for example, as the sheet is driven through the burster the burster rolls will be open and as the leading edge of the sheet passes sensor means 48, it will cause a count to be started in counting means 50 of the pulses from emitter 46. When this count reaches the level corresponding to only 3.5 inches of the trailing edge, it will cause the burster rolls 24 to close to initiate bursting. When the trailing edge of the now-burst sheet reaches burster feeding means 24, it will simultaneously cause these rolls to open and the straight ahead rolls of the offset station to engage. As the trailing edge of the sheet passes sensor 48, the decision is made whether or not to offset in response to a signal from the control unit. The offset operation is accomplished in the same manner as in the 3.5 inch length example by remaining on the sheet until the trailing edge of the sheet exits from the offset station rolls. At this point in time, the leading edge of the sheet will have traveled through drive rolls for 3.5, 5.5 and 7 inches which were disengaged because of the linear cam 102 attached to stacker bed 100, which was set to the 8.5 inch stacker position. The leading edge is then caught in the feeding means 82, 83 and again driven straight ahead through the feeding means 84, 85 into the stacker. All other length sizes operate similarly. Control of the burster for sheet lengths of 5.5, 7, 8.5 and 11 inches is shown in FIG. 7. In response to a PROCESS signal from control means 16, a count of 45 is set into counting means 50 and magnet 40 is energized to close pressure roll 34. The web is present with approximately an inch of the web extending beyond rolls 32 and 34 from the initial thread-up operation or from a previous burst operation so closure of the rolls starts the feed of web 10 through the burster apparatus. Under normal operation, the leading edge of the web reaches sensor 48 before the counter reaches zero. A LEADING EDGE signal is generated as a result and this signal is sent to the control means. Some flutter can occur as the leading edge of the web moves along the path so a count of six elapses after the leading edge is first detected before further control action is taken to remove the possibility of spurious results due to leading edge flutter. After six counts have elapsed, the offset station straight ahead rolls 26 are reset open and a count is placed in counting means 50 based on the length of sheet then being processed as follows:

| Sheet length | Count |
|---|---|
| 5.5 | 51 |
| 7 | 64 |
| 8.5 | 78 |

-continued

| Sheet length | Count |
|---|---|
| 11 | 102 |

As the web is fed, counting means 50 is decremented until a count of 50 is reached. At count 50 a signal BURST LOW current is produced and sent to magnet 42 to close burster pressure roll 38. The full current is not applied at this time to reduce noise and vibration as the magnet is energized. At count 47 the signal BURST HIGH current is applied to magnet 42 to develop the full force between the burster rolls. The burster operates as previously described and at count 34 the BURST HIGH current signal goes down and the outfeed rolls remain energized at reduced pressure. At count 25 the BURST LOW current signal goes down and the outfeed rolls are released. An error check is made at count 10 to determine whether sensor 48 is uncovered and assuming normal operation the trailing edge of the just-burst sheet should have cleared the sensor by this time.

A count of 16 is set in counter 50 at this time and operation continues in this manner until a control unit last sheet decision is made. In response to this signal, the input rolls are opened at count 34. The burst rolls are opened at count 25, and the operation is terminated at count zero at which time the offset station rolls are opened.

While the invention has been particularly shown and described with reference to a preferred embodiment thereof, it will be understood by those skilled in the art that various changes in the form and details may be made therein without departing from the spirit and scope of the invention.

I claim:

1. Apparatus for transporting sheets along a predetermined path at a predetermined velocity to a sheet receiving means comprising:

a plurality of feeding means spaced along said path;

means for selectively actuating each of said feeding means;

sheet receiving means positioned at the end of said path for receiving said sheets in serial order;

means for setting the sheet receiving means to receive a predetermined size sheet; and means actuated by said setting means for selectively actuating said feeding means for feeding said predetermined size sheet to said sheet receiving means.

2. The apparatus of claim 1 wherein each of said feeding means comprises a driven feed roll and a pressure roll mounted for selective movement to a nipforming engagement with the feed roll, and wherein said means for selectively actuating each of the feeding means comprises means for actuating each of said pressure rolls.

3. The apparatus of claim 2 wherein said sheet stacker means comprises a stacker bed member and means for setting the stacker bed member at a plurality of distances relative to said feeding means, each of said distances comprising the distance for stacking a predetermined size sheet on end in said sheet stacker means.

4. The apparatus of claim 3 wherein said means actuated by said setting means comprises a linear cam operatively associated with said sheet stacker means, a plurality of pivoted members each having two arms, said pivoted members each mounted with one arm adjacent to one of said pressure roll means and the other arm extending into operative relationship with said linear cam means so that the linear cam means selectively engages one or more of said pivoted members to move the corresponding pressure roll means to the operative position.

5. Apparatus for transporting sheets along a predetermined path at a predetermined velocity to a sheet receiving means comprising:

a plurality of feeding means spaced along said path;

means for selectively actuating each of said feeding means;

sheet receiving means positioned at the end of said path for receiving said sheets in serial order;

means for setting the sheet receiving means to receive a predetermined size sheet;

means actuated by said setting means for selectively actuating said feeding means for feeding said predetermined size sheet to said sheet receiving means; and means for selectively producing a lateral displacement of said sheet as it is moved along said predetermined path at said predetermined velocity.

6. The apparatus of claim 5 wherein each of said feeding means comprises a driven feed roll and a pressure roll mounted for selective movement to a nip-forming engagement with the feed roll and wherein said means for selectively actuating each of the feeding means comprises means for actuating each of said pressure rolls.

7. The apparatus according to claim 6 wherein said offset means comprises roll feeding means mounted at an angle to said sheet path and driven at a speed substantially faster than said predetermined velocity so that said sheet is laterally offset along said sheet path so that its speed along the sheet path equals the predetermined velocity.

8. The apparatus of claim 7 wherein said sheet stacker means comprises a stacker bed member and means for setting the stacker bed member at a plurality of distances relative to said feeding means, each of said distances comprising the distance for stacking a predetermined size sheet on end in said sheet stacker means.

9. The apparatus of claim 8 wherein said means actuated by said setting means comprises a linear cam operatively associated with said sheet stacker means, a plurality of pivoted members each having two arms, said pivoted members each mounted with one arm adjacent to one of said pressure roll means and the other arm extending into operative relationship with said linear cam means so that the linear cam means selectively engages one or more of said pivoted members to move the corresponding pressure roll means to the operative position.

10. The apparatus of claim 6 wherein said means actuated by said setting means comprises a linear cam operatively associated with said sheet stacker means, a plurality of pivoted members each having two arms, said pivoted members each mounted with one arm adjacent to one of said pressure roll means and the other arm extending into operative relationship with said linear cam means so that the linear cam means selectively engages one or more of said pivoted members to move the corresponding pressure roll means to the operative position.

11. The apparatus of claim 7 wherein said means actuated by said setting means comprises a linear cam operatively associated with said sheet stacker means, a plurality of pivoted members each having two arms, said pivoted members each mounted with one arm adjacent to one of said pressure roll means and the other arm extending into operative relationship with said linear cam means so that the linear cam means selectively engages one or more of said pivoted members to move the corresponding pressure roll means to the operative position.

12. The apparatus according to claim 5 wherein said offset means comprises roll feeding means mounted at an angle to said sheet path and driven at a speed substantially faster than said predetermined velocity so that said sheet is laterally offset along said sheet path so that its speed along the sheet path equals the predetermined velocity.

13. The apparatus of claim 12 wherein said sheet stacker means comprises a stacker bed member and means for setting the stacker bed member at a plurality of distances relative to said feeding means, each of said distances comprising the distance for stacking a predetermined size sheet on end in said sheet stacker means.

14. The apparatus of claim 5 additionally comprising control means for selectively producing a sheet offset signal and means for energizing said offset means when said sheet is at a predetermined position along said predetermined path in response to said sheet offset signal.

* * * * *